US009082305B2

(12) United States Patent
Groves

(10) Patent No.: US 9,082,305 B2
(45) Date of Patent: Jul. 14, 2015

(54) EMERGENCY VEHICLE NOTIFICATION SYSTEM

(76) Inventor: Trevor Groves, Shaughnessy (CA)

( * ) Notice: Subject to any disclaimer, the term of this patent is extended or adjusted under 35 U.S.C. 154(b) by 88 days.

(21) Appl. No.: 13/381,171

(22) PCT Filed: Jun. 18, 2010

(86) PCT No.: PCT/CA2010/000962

§ 371 (c)(1),
(2), (4) Date: Mar. 12, 2012

(87) PCT Pub. No.: WO2011/000083

PCT Pub. Date: Jan. 6, 2011

(65) Prior Publication Data

US 2012/0194353 A1 Aug. 2, 2012

Related U.S. Application Data

(60) Provisional application No. 61/221,172, filed on Jun. 29, 2009.

(51) Int. Cl.
*G08G 1/095* (2006.01)
*G08G 1/0967* (2006.01)

(52) U.S. Cl.
CPC ..... *G08G 1/096716* (2013.01); *G08G 1/095* (2013.01); *G08G 1/096758* (2013.01); *G08G 1/096783* (2013.01)

(58) Field of Classification Search
CPC ..... G08G 1/095
USPC ..... 340/902, 905, 906, 907, 909, 917; 404/10; 455/7, 9, 10, 11.1, 13.1
See application file for complete search history.

(56) References Cited

U.S. PATENT DOCUMENTS

| | | | | |
|---|---|---|---|---|
| 5,133,081 | A * | 7/1992 | Mayo | 455/18 |
| 5,307,060 | A | 4/1994 | Prevulsky et al. | |
| 5,889,475 | A | 3/1999 | Klosinski et al. | |
| 6,404,351 | B1 | 6/2002 | Beinke | |
| 6,529,831 | B1 | 3/2003 | Smith et al. | |
| 7,447,480 | B2 * | 11/2008 | Rieder et al. | 455/41.1 |
| 2004/0145496 | A1 * | 7/2004 | Ellis | 340/905 |
| 2005/0248468 | A1 * | 11/2005 | Glynn | 340/905 |
| 2008/0106435 | A1 | 5/2008 | Kirkpatrick | |
| 2008/0198038 | A1 * | 8/2008 | Yingst et al. | 340/908 |

OTHER PUBLICATIONS

International Search Report prepared by the Canadian Intellectual Property Office on Oct. 7, 2010, for International Application No. PCT/CA2010/000962.

Written Opinion prepared by the Canadian Intellectual Property Office on Oct. 4, 2010, for International Application No. PCT/CA2010/000962.

* cited by examiner

*Primary Examiner* — Hai Phan
*Assistant Examiner* — Zhen Y Wu
(74) *Attorney, Agent, or Firm* — Sheridan Ross P.C.

(57) ABSTRACT

A method for notifying traffic of an approaching emergency vehicle is described. A series of alert units are mounted along a roadway so as to be visible to traffic. A signal is emitted from the emergency vehicle, which is detected by a receiver along the roadway. The receiver causes a light to flash and a relay signal to be sent to the next alert unit along the roadway. Accordingly, an alert signal is propagated along the roadway ahead of the emergency vehicle, alerting traffic.

4 Claims, 2 Drawing Sheets

EMERGENCY VEHICLE NOTIFICATION SYSTEM

CROSS REFERENCE TO RELATED APPLICATIONS

This application is a national stage application under 35 U.S.C. 371 of PCT Application No. PCT/CA2010/000962 having an international filing date of 18 Jun. 2010, which designated the United States, which PCT application claimed the benefit of U.S. Provisional Application No. 61/221,172 filed 29 Jun. 2009, the entire disclosure of each of which is incorporated herein by reference.

FIELD OF THE INVENTION

The present invention relates generally to emergency vehicle warning systems. More particularly, the present invention relates to a system, method, and various components for use in warning traffic regarding the approach of an emergency vehicle.

BACKGROUND OF THE INVENTION

With current trends in suburban development, infrastructure limitations generally result in increasing congestion along feeder routes due to the increasing number of vehicles requiring access to urban areas. Additionally, high density urban housing developments create further congestion and limit access and visibility while driving. This often leaves motorists with limited notice of potential hazards, and fewer options for route adjustment to avoid congested areas. For most road users this poses little more than an inconvenience, easily remedied by lowering their rate of speed, increasing travel time and keeping in tight control of their vehicle.

Emergency vehicles, however, must avoid congested routes or provide appropriate notification to traffic users to clear the desired route for passage of the emergency vehicle. The inherent urgency of emergency vehicle travel necessitates effective notification to other traffic to clear the route as quickly as possible. It has become increasingly difficult to timely notify and navigate congested traffic through urban and suburban areas. It is also generally desirable for emergency vehicles to be able to travel at speeds greater than those permitted for other vehicles. Emergency vehicles travelling at high speeds through congested areas pose a risk to all users of the roadway, as well as to individuals seeking emergency assistance.

Common methods of warning motorists of an approaching emergency vehicle include visual and audible warning devices (lights and sirens of various patterns). Most provinces or states have laws requiring motorists to pull over when such warning mechanisms are near, allowing emergency vehicles the right of way while reducing opportunity for collision.

Warning lights and sirens, however, have limitations. While the majority of drivers are aware of appropriate action to take when an emergency vehicle is approaching (for example, pulling over to the right side of the road), drivers are often startled by lights and sirens approaching from behind, and are also often confused as to the direction of the approaching emergency vehicle. Accordingly, there may be limited opportunity for the driver to manoeuver out of the path of the emergency vehicle. This causes erratic motorist response, and confusion for all parties. It is therefore common for emergency vehicles to be seen weaving in and out of such erratic/stalled traffic.

Thus, drivers of emergency vehicles typically must proceed more slowly than desirable, increasing their response time.

U.S. Pat. No. 5,307,060 to Prevulsky, describes a vehicle to vehicle emergency communication system. Emergency vehicles are equipped with transceivers for communication with other emergency vehicles, and for sending alerts to non-emergency vehicles. Non-emergency vehicles are equipped with a vehicle alert receiver to receive permit notification of an approaching emergency vehicle and its type.

Similarly, U.S. Pat. No. 6,529,831 to Smith, describes an in-vehicle notification and navigation system to allow a driver to navigate away from the path of an second (presumably an emergency) vehicle.

Beinke, in U.S. Pat. No. 6,404,351, teaches a system for installation in emergency vehicles. The system not only notifies other vehicles of approaching emergency vehicles, but also has the ability to change traffic lights in a further effort to clear the roadways for emergency traffic. Non-emergency vehicles receive in-car alerts via an installed directional display and speaker.

U.S. Pat. No. 5,889,475, issued to Klosinski, describes alert transmissions across AM and FM frequencies to warn vehicles through existing radio devices.

In summary, lights and sirens currently serve the purpose of general notification to surrounding drivers of a nearby emergency vehicle, but emergency vehicle-based lights and sirens are limited in the quality of information provided to other drivers. More specific notification technologies (as discussed above) generally require installation of specialized equipment directly within emergency and non-emergency vehicles to enable an alert service. It would be desirable to provide suitable notification to drivers regarding the direction of approach of an emergency vehicle, without requiring installation of specific equipment within the non-emergency vehicles.

SUMMARY OF THE INVENTION

It is an object of the present invention to obviate or mitigate at least one disadvantage of previous emergency vehicle notification systems.

In a first aspect, there is provided a traffic notification system comprising: a signal generator for emitting an emergency signal; a series of signal receivers for receiving emergency signals; a series of traffic alert devices, each alert device associated with at least one of the signal receivers such that when the receiver detects an emergency signal, the corresponding traffic alert device is activated; and a series of signal relays, each signal relay associated with one of the signal receivers such that when the receiver detects an emergency signal, the signal relay sends a corresponding emergency signal in the direction of another one of the signal receivers, thereby propagating the emergency signal.

In an embodiment, the signal generator is a transmitter on an emergency vehicle.

In a further embodiment, the series of signal receivers, alert devices, and signal relays are arranged along a roadway. The system may further comprise a series of alert units, each alert unit for containing one of the signal receivers, one of the alert devices, and one of the signal relays.

In an embodiment, the receiver reduces the intensity of the signal prior to the signal relay sending the corresponding emergency signal, such that each successive signal relay propagates an emergency signal of successively reduced intensity.

In accordance with a second aspect, there is provided a method for alerting traffic of an approaching emergency vehicle, the method comprising the steps of: emitting a first emergency signal from an emergency vehicle; detecting the signal with a first receiver at a first location along a roadway; activating an alert device at the first location to alert nearby traffic of the approaching emergency vehicle; and initiating a relay signal at the first location to propagate the first emergency signal to another receiver at a second location along the roadway.

In a third aspect, there is provided an alert unit for mounting along a roadway, the alert unit comprising: a receiver for detecting an emergency signal; an alert device for displaying an emergency alert in response to emergency signal detection by the receiver; and a relay signal generator for activation by the receiver upon detection of an emergency signal, the relay signal generator for propagating the emergency signal to another alert unit along the roadway.

In a fourth aspect, a method is provided for displaying an emergency alert along a roadway, the method comprising the steps of:

providing a plurality of alert units, each comprising: a receiver for detecting an emergency signal, an alert device for displaying an emergency alert in response to emergency signal detection by the receiver; and a relay signal generator for activation by the receiver upon detection of an emergency signal, the relay signal generator for propagating a relay signal from the alert unit;

placing the alert units in series along a roadway such that the receiver of each successive alert unit is within detection distance of the preceding alert unit relay signal, when activated; and emitting an emergency signal in proximity to one of the alert units so as to initiate propagation of an emergency signal and alert along the roadway.

In a fifth embodiment, a method is provided for alerting traffic of an approaching emergency vehicle by activating a series of flashing lights along a roadway, in the direction of travel of the emergency vehicle.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides an emergency vehicle alert system.

A system and method are described for notifying appropriate vehicles of the existence and direction of travel of an approaching emergency vehicle (e.g. police, fire or ambulance). Accordingly, drivers are aware that the emergency vehicle is approaching from behind, and can take action to clear the roadway, facilitating faster emergency response times and reducing confusion and potential for accidents.

Figure 1:
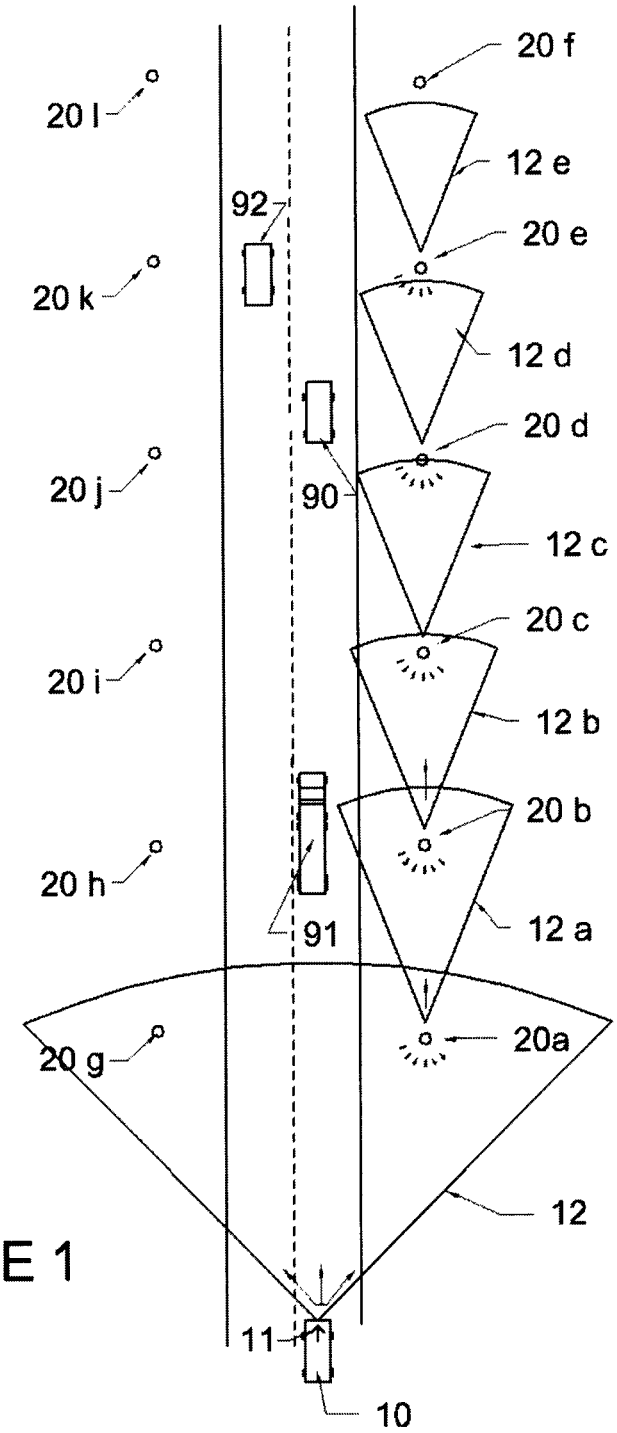
FIG. 1 is a schematic drawing showing operation of an alert system along a roadway.
Figure 2:
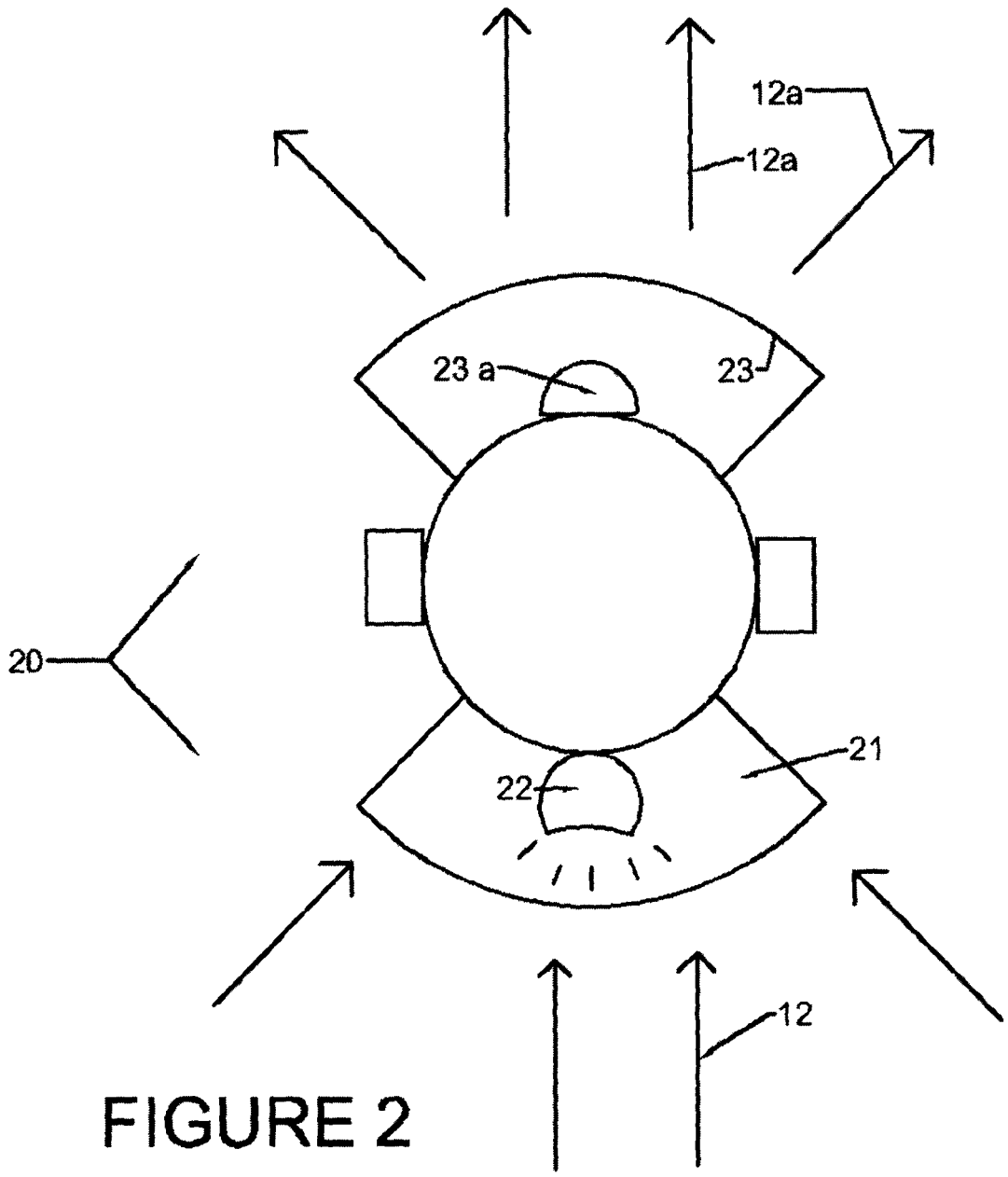
FIG. 2 is a schematic drawing of an alert unit.

Referring to FIGS. 1 and 2, an emergency vehicle 10 is equipped with a transmitter 11, that emits a pulsing signal swath 12 in the direction of travel. Alert units 20 are present along each side of the roadway, and each contains a receiver 21 and alert light 22, both facing oncoming traffic, and a relay signal 23, directed towards the next alert unit 20 along the roadway. Accordingly, an emergency vehicle 10 travelling along the roadway will emit a signal swath 12 that is detected by the receiver 21 of any alert units within range, activating the alert light 22 and relay signal 23. Thus, the alert light 22 will flash and be visible by drivers travelling ahead of the emergency vehicle. The alert unit 20 will also propagate the emergency signal to the next alert unit along the roadway by flashing relay signal 23.

The system can easily be deployed within a municipality, without need for individual vehicle owners to install any device in their own vehicles. The system makes use of existing infrastructure (for example lampposts, guardrails, etc.) as mounting points for the alert units 20, and transmitters can be installed in emergency vehicles as desired. Once installed, the alerting system is functional for all drivers collectively and immediately.

Thus, a method for notifying drivers of emergency vehicles is available by visual queue of pulsing light, travelling directly in front of a driver. Drivers see a pulse of light along the roadway, travelling down the road ahead of their vehicle. As the light pulse will travel faster than traffic flow, drivers will see a repeating pulse of light travelling in a forward direction, indicating that an emergency vehicle is approaching from the rear. The driver therefore has time to respond, knowing that soon an emergency vehicle will be within visual/audible range.

A series of programmed microcontrollers work as a system to effectively produce a network of visible travelling light pulses ahead of the emergency vehicle, customized for distance and speed by road conditions. Once the alert units 20 are in place along a thoroughfare, they form an independent safety network that can be extended, and/or modified to fit changing traffic conditions. The components of the alert units 20 (receiver 21, alert light 22, and relay signal 23) may instead be provided as separate devices and mounted along the roadway as desired.

Depending on speed of traffic and notification requirements, each mounted unit is programmed for distance and intensity of the pulsating light travel. Range of pulsating light travel maybe set to multiple miles/kilometers ahead of the triggering emergency vehicle depending on traffic needs. The result provides a clear path for emergency vehicles by giving drivers time to react prior to the actual presence of the emergency vehicle.

Transmitter

The transmitter 11 is mounted to an emergency vehicle. Communication between the transmitter and alert units may be by any means suitable for signal propagation. A signal of graded, measurable intensity will allow the system to fade the signal as it is propagated from the origin, if this is desirable for the specific application. A directional signal will allow the signal to be aimed along a particular side of the roadway, or otherwise oriented to receivers of interest.

With reference to FIG. 1, an infrared signal is pulsed to create a 45-60 degree swath ahead of the emergency vehicle. The angle of this signal allows detection by alert units along the right side of the road (i.e. in the direction of travel of the emergency vehicle), as the receivers of these alert units are facing oncoming traffic, but does not activate alert units on other streets or on the opposite side of the roadway due to orientation of the receivers (see below).

The strength and timing of pulsing may be preset to a general setting, or may be controlled from within the emergency vehicle (or remotely) based on the general traffic patterns and road conditions present, as well as on the location of alert units 20.

Alert Units

Multiple receivers, relay signals, and lights are placed along the roadway. Each of these components may be contained within an alert unit 20, as shown in FIG. 2. Typically, the units would be mounted to light standards, telephone poles, guardrails, the road surface itself, or any other suitable structure along the roadway that is visible to traffic.

Generally, the receiver is mounted and oriented to face oncoming traffic. By facing traffic, the receiver can detect the pulsing signal swath 12 of oncoming emergency vehicles, or of an adjacent relay signal, for example from a nearby alert unit 20. However, the receiver cannot detect signals from vehicles travelling in the opposite direction, or on nearby streets. In this manner, signals are only propagated in the direction of travel of the initiating emergency vehicle.

The receiver is in communication with an associated alert light 22 and relay signal 23, activating both when an emergency signal is detected. The receiver may be deactivated for a set period of time after a signal detection to ensure proper timing of signal propagation along the roadway.

The alert light is similarly placed alongside the roadway and facing oncoming traffic. Upon activation by communication from the receiver, the alert light flashes, and is visible to oncoming traffic. With appropriate signal propagation, the alert lights will generate a travelling light pulse in the direction of emergency vehicle traffic that will be easily visible and recognizable to other drivers. The alert lights may take multiple forms such as colored LED lights, strobe light, patterned light flashes, or any other means of conveying information effectively to motorists.

The relay signal is oriented in opposite direction to the alert light such that it faces the receiver of the next alert unit. In this manner, the alert lights along the roadway are flashed in succession, creating a self-propagating signal along the roadway as to the direction of approach of the emergency vehicles.

Termination of Propagation

In order to prevent endless propagation of the signal along the roadway, which may be unnecessary and counterproductive if the emergency vehicle stops of turns off the current roadway, the propagating signal may be measured and reduced in intensity at each relay to limit the distance of propagation.

The receiver may include an intensity meter that measures the intensity of the signal received from the previous alert unit. The alert unit may then reduce the intensity of the signal relayed to the next alert unit. Accordingly, this would ensure that over a given number of relays, the signal would diminish and then eventually fail to propagate after a given distance from the original signal.

The intensity or count of the signal may be detected by appropriate programming of the alert unit microprocessor. The detected signal may then be reduced by an appropriate amount for relay to the next alert unit, thereby reducing the intensity of the signal as it is propagated. The amount of reduction in signal strength will be set to allow propagation to an appropriate distance from the originating signal, which will depend on various factors including the distance between the alert units, the average speed of traffic along the roadway, typical visibility, configuration of the roadway and cross streets, etc.

Method

With reference to FIG. 1, upon approach of an emergency vehicle 10 along a roadway, the emergency vehicle would typically be flashing lights and sounding a siren, in proximity to vehicles 90, 91, 92. While vehicle 91 would be aware of the location of the emergency vehicle using rear view and/or side view mirrors, vehicle 90 may not be able to see the emergency vehicle 10, but will hear the siren. Generally, drivers that detect an audible siren but are not able to determine the location or direction of the emergency vehicle will slow down and look in all directions, causing traffic confusion.

In accordance with the system shown in FIG. 1, the emergency vehicle emits a pulsing signal swath 12 from emitter 11. The pulsing swath only reaches a certain distance from the emergency vehicle 10, and therefore may only be detectable by alert unit 20*a*. Alert unit 20*g* cannot detect the pulsing signal swath 12 because the receiver in alert unit 20*g* is facing the opposite direction. Accordingly, none of alert units 20*b*-20*l* will detect the emergency vehicle signal swath 12 at this point in time.

Thus, the receiver on alert unit 20*a* detects the emergency vehicle emission, flashes light on alert unit 20*a*, which is visible only to the emergency vehicle 10. The alert unit 20*a* sends a relay signal 12*a* to alert unit 20*b*. Unit 20*b* measures the intensity of the signal, flashes its light, and activates relay signal 12*b* within alert unit 20*b* at a reduced intensity. Adjacent unit 20*c* detects the reduced intensity signal, flashes its light, and reduces the intensity of the signal 12*c* relayed to alert unit 20*d*. Similarly, the signal propagation and light flashes continue until the signal is too weak to activate the following alert unit (20*f*).

Once the flashes of light are initiated, the driver of vehicle 90 is aware that the emergency vehicle is approaching from behind due to the visible light flashes along the roadway in his direction of travel, even though the driver cannot see the emergency vehicle due to the large vehicle 91 behind. Vehicle 91 need not look around confused, but can pull over knowing he must clear a path for the approaching emergency vehicle.

Conversely, should the driver of vehicle 92 notice the light flashes, he can be assured that the approaching emergency vehicle is not approaching from behind, as there are no flashing lights in his direction of travel. The driver may observe the flashing lights on the opposite side of the road and determine whether any action is required.

Meanwhile, emergency vehicle has progressed along the roadway and is still emitting the pulsing signal swath 12, which by now may be in directly within range of alert unit 20*d*. If alert unit 20*d* has recovered from its previous signal relay, it can now detect and act upon the signal from the emergency vehicle 10. Accordingly, the propagating light flashes are repeated based on the direction of travel of the emergency vehicle.

The signal 12 may be disabled within the emergency vehicle 10 as desired, for example when the road is clear or the destination has been reached.

Other Embodiments

As an alternative to unidirectional signal propagation along one side of a roadway, some systems may employ bidirectional alert units (flashing a propagating signal on either side of the alert unit), which may be placed on either side of the roadway. In such an arrangement, the pulse of light travelling with the emergency vehicle may be duplicated along both sides of the roadway for additional visibility. Further, when a bidirectional alert signal is propagated, the signal would also be visible to oncoming traffic. As a result, oncoming traffic would see a travelling pulse of light approaching head-on, and may slow down or pull to the right to clear the middle of the roadway.

The pulsing signal swath may also be used to activate or disable other systems, for example traffic lights, custom in-car alert systems, and the like.

The system may also be used to warn drivers of other hazards such as wildlife, pedestrians, etc. Various types of lights and displays may be used, for example specific colors indicating specific types of hazards, providing more specific information to motorists.

Other types of alerts may also be propagated by the alert unit, including sirens, radio signal interruptions or emergency messages, and the like.

Traffic control systems that rely on a centrally controlled system, network communication, and other similarly connected systems have many potential failure points that rely on other technologies and modes of communication to operate. To avoid technological failure, the present system effectively builds a self reliant communications network, self propagating, and requires minimal user input to trigger, monitor or function effectively. Should contemporary traffic systems fail, this method would additionally serve as a backup for traffic emergency notification.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A traffic notification system comprising:

a signal generator for emitting a first emergency signal;

a series of signal receivers for receiving the first emergency signal;

a series of traffic alert devices, each alert device associated with at least one of the signal receivers such that when a receiver of the series of signal receivers detects the first emergency signal, a corresponding traffic alert device is activated; and a series of signal relays, each signal relay associated with one of the signal receivers such that when the receiver of the series of signal receivers detects the first emergency signal, a corresponding signal relay sends a corresponding second emergency signal in the direction of another one of the signal receivers, thereby propagating the first emergency signal; and wherein the receiver reduces the intensity of the first emergency signal prior to the signal relay sending the corresponding second emergency signal, such that each successive signal relay propagates the second emergency signal having a successively reduced intensity.

2. The traffic notification system as in claim 1, wherein the signal generator is a transmitter on an emergency vehicle.

3. The traffic notification system as in claim 1, wherein the series of signal receivers, alert devices, and signal relays are arranged along a roadway.

4. The traffic notification system as in claim 1, further comprising a series of alert units, each alert unit containing one signal receiver, one alert device, and one signal relay.

* * * * *